United States Patent [19]

Vondracek

[11] 4,193,626

[45] Mar. 18, 1980

[54] SNOW SCOOP

[76] Inventor: James Vondracek, 2630 Wallace Dr., Flossmoor, Ill. 60422

[21] Appl. No.: 904,526

[22] Filed: May 10, 1978

[51] Int. Cl.[2] ..... E01H 5/02

[52] U.S. Cl. ..... 294/54; 37/53

[58] Field of Search ..... 294/49, 53.5, 54–57; 37/53, 130

[56] References Cited

U.S. PATENT DOCUMENTS

| | | | |
|---|---|---|---|
| 138,541 | 5/1873 | Stiles | 294/55 |
| 996,621 | 7/1911 | Danielson | 294/49 |
| 1,162,845 | 12/1915 | Armstrong | 294/53.5 |
| 1,766,691 | 6/1930 | Rugg | 37/53 |
| 1,799,204 | 4/1931 | Wily | 294/54 |
| 3,155,413 | 11/1964 | Holombo | 294/54 |
| 3,751,058 | 8/1973 | Larsen | 37/130 X |

FOREIGN PATENT DOCUMENTS

| | | | |
|---|---|---|---|
| 681680 | 3/1964 | Canada | 37/53 |
| 180904 | 2/1936 | Switzerland | 294/54 |

*Primary Examiner*—Johnny D. Cherry

*Attorney, Agent, or Firm*—Leydig, Voit, Osann, Mayer & Holt, Ltd.

[57] ABSTRACT

A push type snow scoop adapted for faster and easier removal of snow from sidewalks, driveways and the like without the need for manual lifting. The scoop includes a stamped, one-piece metal body having a relatively lightweight, rigid construction which facilitates shearing of snow from the surface to be cleaned and the easy ejection of snow from the scoop. The body of the illustrated scoop is formed with an outwardly extending coplanar flange about its outer periphery that is disposed at an acute angle to the surface to be cleared. The leading edge of the scoop is formed by a short flange parallel to the bottom of the scoop which facilitates movement of the scoop over even rough or uneven surfaces and gives further rigidity to the expanse of metal.

6 Claims, 5 Drawing Figures

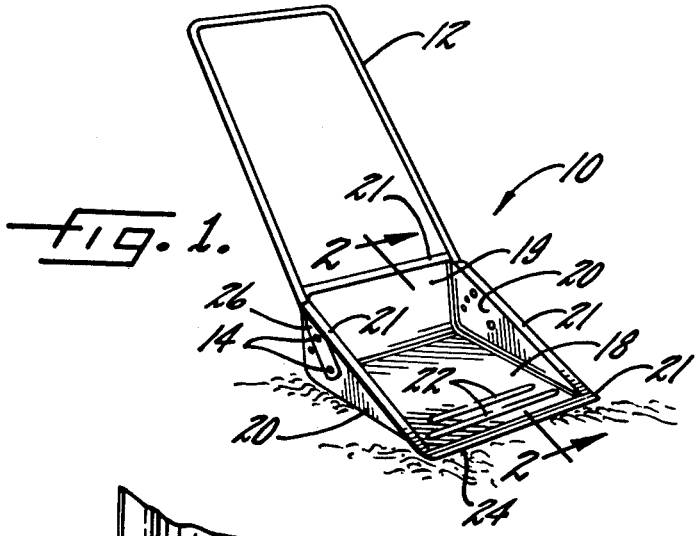
Fig. 1.
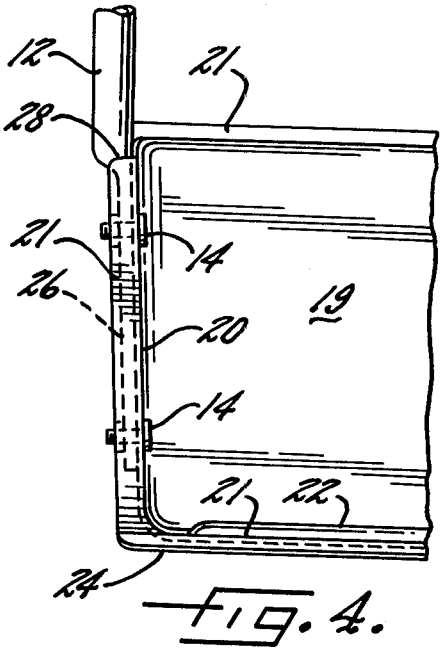
Fig. 4.
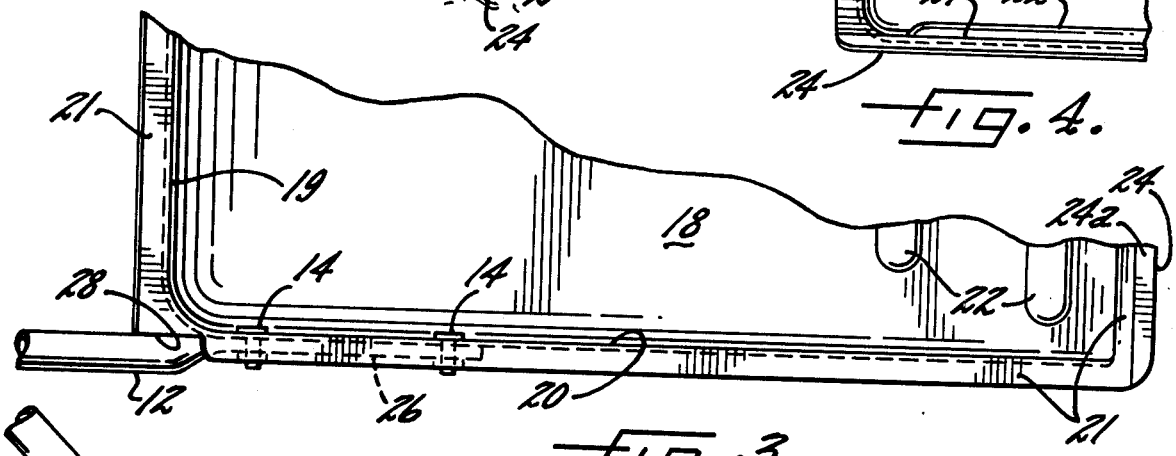
Fig. 3.
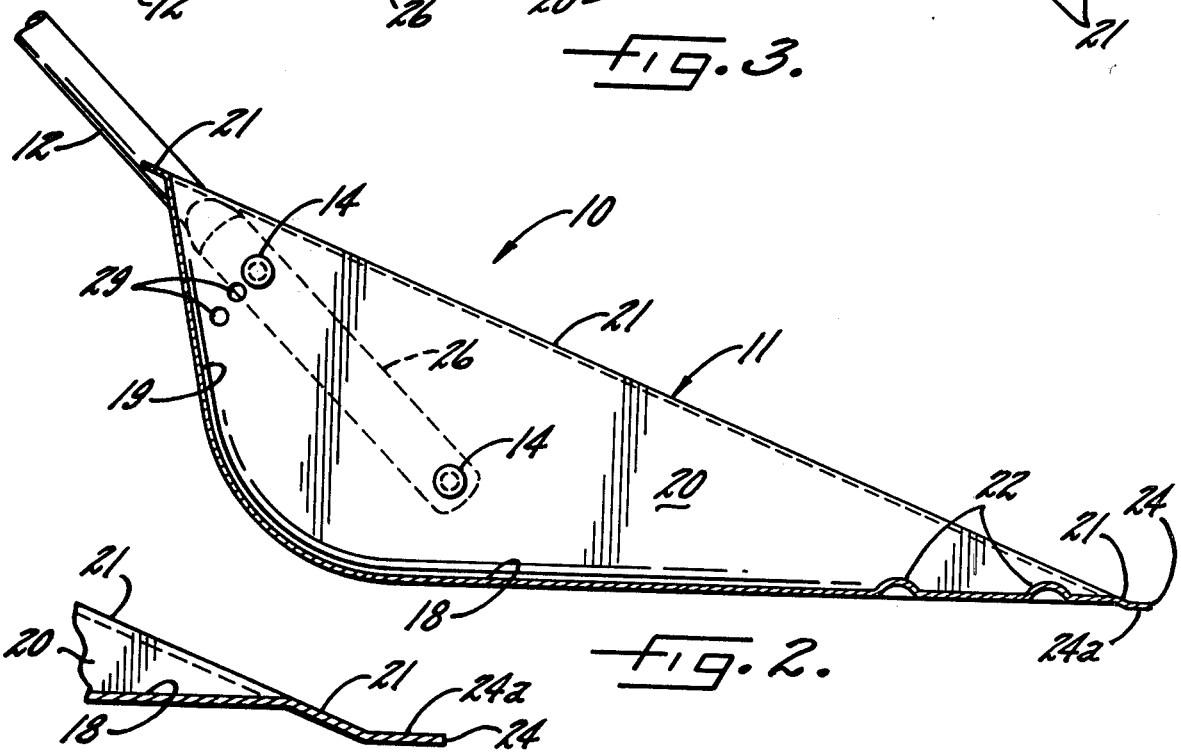
Fig. 2.
Fig. 5.

SNOW SCOOP

DESCRIPTION OF THE INVENTION

The present invention relates to scoops particularly adapted for removing and disposing of snow on sidewalks, driveways and the like.

The removal of heavy snow by manual scoops and shovels has long been recognized as exceedingly burdensome and, in fact, a dangerous undertaking for many. The common commercialy available snow shovel has consisted of a blade and a single rearwardly extending handle, and when removing heavy snow, such shovels usually require that the user lift each scoop of snow that is to be removed. For deep or wet snow, such lifting requires great effort and has proven to be a dangerous strain for those with heart problems. While various push type snow scoops have been proposed, such scoops frequently are heavy, difficult to manipulate and push through snow, and often do not easily eject or discharge wet or heavy snow without some lifting effort. Some prior push type snow scoops also have been difficult to use when clearing hard packed snow and tend to dig into the surface being cleared. Moreover, such scoops have required extensive reinforcement in order to prevent bending or damge to the scoop during such use on ice or hard packed snow.

It is an object of the present invention to provide an improved push-type snow scoop that facilitates faster and easier removal of snow.

Another object is to provide a snow scoop as characterized above which may be pushed through even heavy snow without extensive effort. A related object is to provide a such snow scoop that is adapted to readily penetrate and shear hard packed snow and ice.

A further object is to provide a snow scoop of the above kind which is of relatively lightweight, rigid construction.

Still another object is to provide a such snow scoop which has relatively few parts and lends itself to high-capacity economical manufacture.

Yet another object is to provide a snow scoop of the foregoing type which is adapted to facilitate easy ejection of the snow from the scoop without the exertion of lifting forces.

Other objects and advantages of the invention will become apparent upon reading the following detailed description and upon reference to the drawings, in which:

FIG. 1 is a perspective of an illustrative snow scoop embodying the present invention;

FIG. 2 is an enlarged fragmentary section taken in the plane of line 2—2 in FIG. 1;

FIG. 3 is an enlarged partial top view of the snow scoop shown in FIG. 1;

FIG. 4 is an enlarged partial end view of the snow scoop shown in FIG. 1; and

FIG. 5 is an enlarged fragmentary section of the leading edge of the illustrated snow scoop.

While the invention is susceptible of various modifications and alternative constructions, a certain illustrative embodiment thereof has been shown in the drawings and will be described below in detail. It should be understood, however, that there is no intention to limit the invention to the specific forms disclosed, but, on the contrary, the intention is to cover all modifications, alternative constructions, and equivalents falling within the spirit and scope of the invention.

Referring now more particularly to FIG. 1 of the drawings, there is shown an illustrative snow scoop 10 embodying the present invention. The scoop 10 basically includes a scoop body 11 and a handle 12. The handle 12 in this case is U-shaped having a pair of legs secured to the scoop body portion 11 by bolts 14 such that the handle extends upwardly at an angle to the horizontal.

In accordance with the invention, the scoop body has a one-piece stamped construction which is lightweight and rigid and facilitates easy removal and ejection of snow. The illustrated scoop body 11 is formed with a bottom panel 18, a rear panel 19 and tapered side panels 20 extending from the rear panel to a leading edge 24 of the bottom panel to define a snow receiving area. The body 11 preferably is formed from a lightweight material, such as 20-gauge sheet metal.

For enhancing the rigidity of the scoop body, the rear, side and bottom panels 18, 19, 20 are formed with coplanar outwardly extending flanges 21 disposed at an acute angle to the bottom panel 18 and to the surface which is to be cleared. The flanges 21 not only signficantly enhance the rigidity of the body 11, but also tend to create a wedge type of clearing action with the surface from which snow is being removed. The coplanar flanges 21 preferably are in a plane disposed at an angle of between 15° to 30° to the surface to be cleared, and in the illustrated embodiment, the flanges are in a plane disposed at an angle of about 22°. To further increase the rigidity of the scoop body 11, the front forward portion of the bottom panel 18 is formed with transverse grooves 22 parallel and in space relation to the leading edge 24.

In keeping with the ivention, the leading edge 24 of the scoop body is formed with a narrow flange **24*a* that is parallel to the bottom panel 18 to facilitate movement of the scoop over uneven or rough surfaces without cutting or digging into the surface. The flange 24*a* need only be on the order of about ¼ inch in width, and preferably is formed as a forwardmost extension of the flange 21 extending forwardly of the bottom panel 18**.

For facilitating ejection and removal of snow from the scoop body 11, the rear panel 19 preferably is formed at an obtuse angle to the bottom panel 18, such as an angle of about 101°. Furthermore, the body panels 18, 19 and 20 all join with rounded corners to further facilitate easy removal of snow from the scoop. Such construction has been found to substantially eliminate the compacting or sticking of snow that can occur in the corner of the two perpendicular surfaces.

It will be appreciated that the scoop body 11, with the aforesaid reinforcing flanges 21 and grooves 22, may be economically produced by conventional stamping techniques. Not only do such techniques lend themselves to efficient high production with resulting cost savings, but the deformation of the metal during such stamping processes work hardens the metal to further enhance the rigidity of the formed structure.

In order to permit the most efficient use of the scoop of the present invention, the handle 12 is adjustable to accommodate users of different heights. The illustrated scoop 10 is shown with the handle 12 at an angle of approximately 45° to the ground, which has been found to be the optimum position for persons of average height. To facilitate assembly of the U-shaped handle in such position, the ends of the handle are formed with apertured flanges 26 which are positionable immediately adjacent respective side panels 20 of the scoop body. To accommodate the handle legs in such position, the flange 21 of the body 11 is relieved as shown at 28 in FIG. 3. The handle 12 mounted in such manner will readily transmit horizontal pushing forces applied to the handle during use of the scoop to the body 11 to enable it to be forced through even heavy or hard-packed snow with relative ease. To permit the more direct transmission of pushing forces to the scoop body by shorter users, the handle 12 may be lowered by removing the upper screw 14 in each handle, pivoting the handle about the lower fastening screws, and resecuring the handle in a selected one of several other apertures 29 formed in the side panels 20 of the scoop body.

In use of the scoop 10 of the present invention, the handle 12 is first adjusted to the angle that is most comfortable for the individual user and will permit the most direct transmission of horizontal pushing forces to the scoop body 11. The scoop may then be positioned on the walk or drive that is to be cleared and pushed horizontally along that surface. The wedge shaped reinforcing flange 21 tends to facilitate penetration and loosening of even hard-packed snow surfaces, while the relatively small horizontal leading flange 24*a* allows the scoop body to glide over even rough surfaces without cutting into the surface or protrudences thereon. For emptying the scoop body 11, the scoop is simply moved with quick push-pull actions which causes the snow to quickly eject from the scoop body by inertial forces. The stamped one-piece scoop body 11 with its resulting lack of seams and joints not only enhances its rigidity, but facilitates the easier displacement of the snow with such quick movements. Thus, the scoop of the present invention has been found to permit quick clearing of even deep snow without any significant lifting effort by the user.

From the foregoing it will be seen that the push-type snow scoop of the present invention facilitates faster and easier removal of even deep or heavy snow with relative ease and with no lifting or bending effort required. The one piece stamped scoop body is of lightweight rigid construction which lends itself to high capacity economical manufacture, and which further facilitates penetration and shearing of even hardpacked snow and its easy removal from the scoop.

I claim as my invention :

1. A scoop for clearing snow from surfaces such as sidewalks, driveways and the like comprising a one-piece stamped body formed with a bottom panel, rear panel and side panels connecting said rear and bottom panels to form a snow receiving area, a generally U-shaped handle formed with a pair of legs, means connecting said handle legs to said side panels whereby manual pushing of said handle imparts horizontal movement to said body along the surface to be cleared, said bottom panel being formed with a forwardly extending reinforcing flange along its forward end, said side panels being formed with flat, outwardly extending reinforcing flanges along their upper edges which extend forwardly to join with said reinforcing flange for said bottom panel, said reinforcing flanges being in a common plane disposed at an angle of between 15° and 30° to said bottom panel and the surface to be cleared for increasing the rigidity of said body and facilitating shearing of snow from said surface, and said flange for said bottom panel extending forwardly from said bottom panel and terminating with a flange that is parallel and slightly below the plane of said bottom panel to form a leading edge of said scoop body.

2. The scoop of claim 1 in which said rear panel is formed with a flange that is in the same plane as said coplanar flanges of said bottom and side panels, and said coplanar flanges of said rear and side panels all extend outwardly of the respective panels.

3. The scoop of claim 2 in which a forward portion of said bottom panel is formed with reinforcing grooves parallel to said leading edge.

4. The scoop of claim 1 in which said coplanar flanges are in a plane disposed at an angle of about 22° with the surface to be cleared.

5. The scoop of claim 1 in which said rear panel makes an obtuse angle with said bottom panel to facilitate ejection of said snow from said body portion.

6. The scoop of claim 1 in which said means for connecting said handle legs to said side panels includes releasable fasteners each passing through aligned apertures in said legs and side panels and said side panels being formed with additional apertures to permit selective adjustment of the angle said handle makes with the surface to be cleared.

* * * * *